United States Patent [19]

Haentjens

[11] Patent Number: 4,747,757

[45] Date of Patent: May 31, 1988

[54] SUBMERSIBLE MIXING PUMP

[76] Inventor: Walter D. Haentjens, R.D. #1 - Box 121, Sugarloaf, Pa. 18249

[21] Appl. No.: 935,004

[22] Filed: Nov. 26, 1986

[51] Int. Cl.[4] ..... F04B 35/04; F04B 39/12; B01F 5/12

[52] U.S. Cl. ..... 417/366; 366/263

[58] Field of Search ..... 417/366, 370, 367, 368, 417/431; 366/263, 264; 415/219 C

[56] References Cited

U.S. PATENT DOCUMENTS

| | | | |
|---|---|---|---|
| 1,264,688 | 4/1918 | Schilling | 417/431 |
| 2,120,914 | 6/1938 | Vogel | 417/368 |
| 2,497,650 | 2/1950 | Anderson | 417/366 |
| 2,520,880 | 8/1950 | Harlamoff | 417/366 |
| 2,784,672 | 3/1957 | Wallace | 417/370 |
| 3,022,739 | 2/1962 | Herrick | 417/369 |
| 3,025,799 | 3/1962 | Hallerback | 417/366 |
| 3,316,843 | 5/1967 | Vaughan | 366/264 |
| 3,398,687 | 8/1968 | Yoshikawa | 417/366 |
| 3,653,785 | 4/1972 | Dahlgren | 417/367 |
| 3,790,309 | 2/1974 | Volz | 417/369 |
| 3,826,595 | 7/1974 | Bottoms | 417/370 |
| 3,975,117 | 8/1976 | Carter | 417/370 |

FOREIGN PATENT DOCUMENTS

| | | | |
|---|---|---|---|
| 760591 | 11/1956 | United Kingdom | 417/366 |

OTHER PUBLICATIONS

Barrett, Haentjens & Comp., Bulletin 48,011, entitled Submersible Slurry Pump for Settled Solids Type "SSB".

*Primary Examiner*—William L. Freeh

*Attorney, Agent, or Firm*—Hill, Van Santen, Steadman & Simpson

[57] ABSTRACT

A bottom inlet submersible mixing pump includes a twin volute centrifugal pump feeding a pair of vertical passageways which in turn feed an annular chamber extending around the motor stator for cooling. The annular chamber has partial dividing walls between the chamber inlets and the chamber outlets which feed discharge nozzles so as to insure a predetermined liquid level within the chamber.

12 Claims, 2 Drawing Sheets

FIG. 1
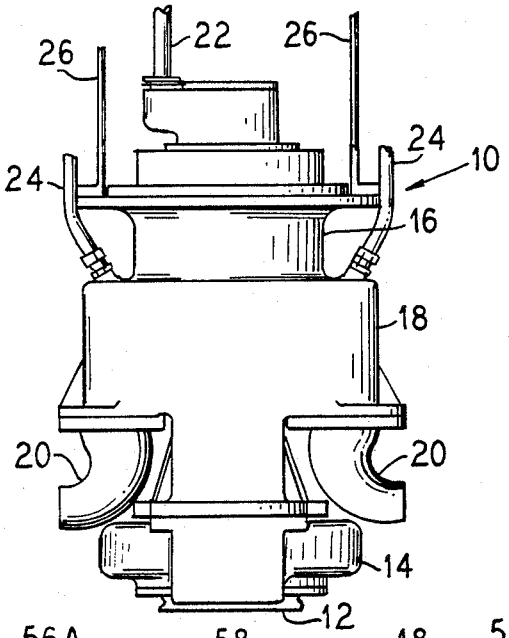
FIG. 5
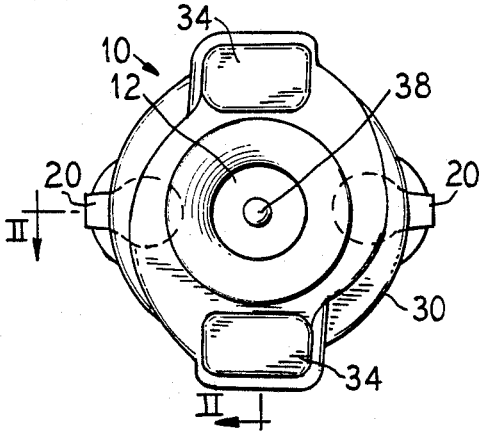
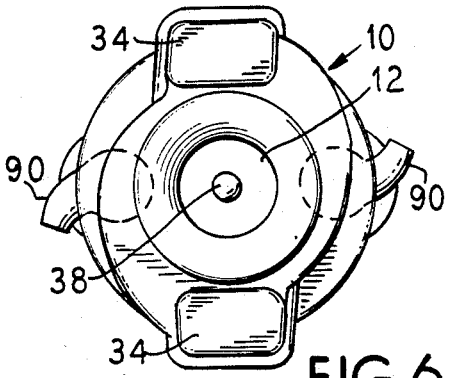
FIG. 6
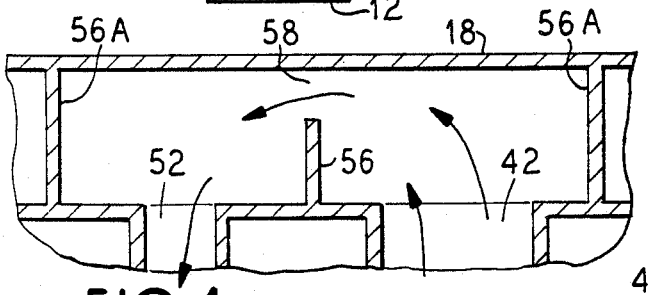
FIG. 4
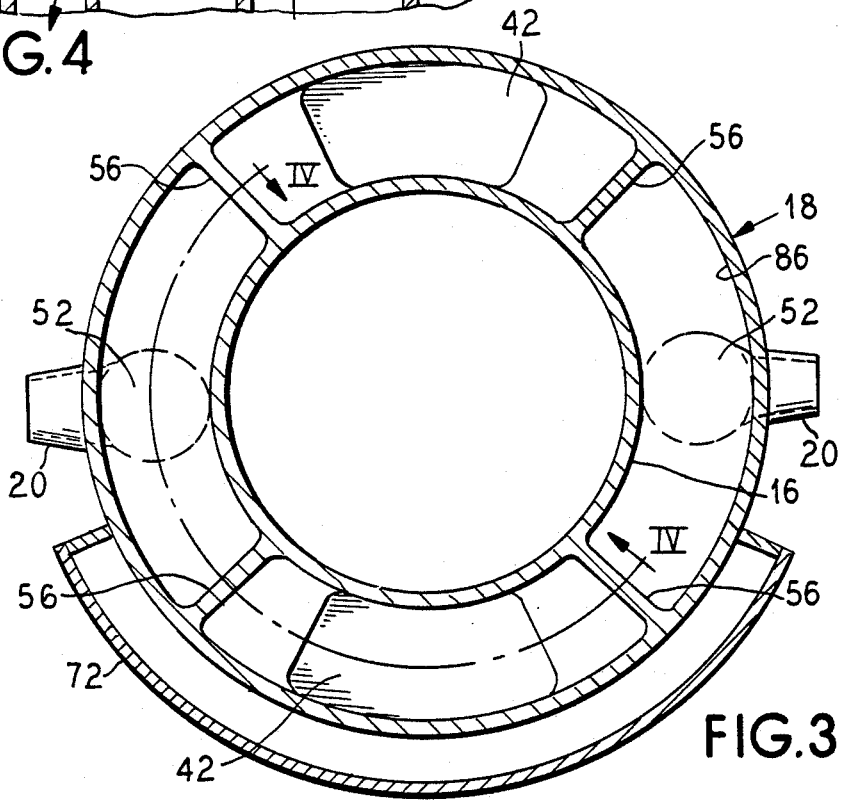
FIG. 3

SUBMERSIBLE MIXING PUMP

BACKGROUND OF THE INVENTION

1. Field of the Invention

The present invention relates generally to a pump and, more particularly, to a submersible, volute mixing pump.

2. Description of the Prior Art

Mixing of settled solids into a liquid within a tank or maintaining the solids in liquid suspension is difficult, particularly in deep tanks. As such, submersible pumps have been provided for setting settled solids in motion, such pumps generally being referred to as slurry pumps. Both the motor and the pump are submersible into a liquid. Many of the known submersible pumps require that the motor be submerged for cooling purposes, although such pumps can generally operate for short periods of time without the motor being submerged before motor temperatures become excessive. However, when there is a great variation in the liquid level, it sometimes occurs that the motor operates in a non-submerged condition long enough to become damaged.

One known submersible pump provides a passageway alongside the motor housing for the liquid being pumped so that cooling is provided for the motor regardless of the liquid level outside the pump. This pump includes a bottom inlet and permits pump operation during non-submergence conditions, even when the pump is ingesting some air along with the liquid. This bottom inlet pump feeds the pumped liquid upward alongside the motor housing and to a conduit through which the slurry is pumped.

SUMMARY OF THE PRESENT INVENTION

An object of the present invention is to cool a pump motor for a submersible mixing pump during operation in a nonsubmerged condition.

Another object of the present invention is to provide discharging of a pumped slurry directly back into the reservoir from which it was pumped.

This and other objects of the present invention are achieved in a submersible mixing pump having a bottom inlet connected to a volute centrifugal pump that discharges into a chamber extending around the stator of the pump drive motor. The chamber encircles the motor stator housing and includes dividers or partitions between an inlet from the centrifugal pump and an outlet opening to insure that the liquid level within the chamber is at least as high as the motor stator. The outlet opening in the chamber connects to a discharge passage that feeds a discharge nozzle. The nozzle discharges into the liquid being pumped by the submersible mixing pump back into the reservoir from which the liquid was pumped.

In one embodiment of the present invention, the centrifugal pump is a twin volute pump having a pair of oppositely disposed pump outlets that feed upward into the chamber encircling the motor stator at chamber inlets. The chamber has a pair of outlets, each disposed at approximately 90° to the chamber inlets. A partial dividing wall, or partition, extends across the chamber between each of the chamber inlets and the chamber outlets, there being four such partial dividing walls spaced equally about the chamber. The partial dividing walls extend upwardly at least as high as the pump motor stator so that the pumped liquid must flow up to the stator before being expelled from the chamber.

Cooling of the motor is thereby insured by the pumped liquid.

In a second embodiment, two oppositely disposed ones of the partition walls completely block the chamber, while the other two partitions are provided spaced equally about the annular rise only as high as the motor stator so that a flow passageway is defined from each chamber inlet to a respective single chamber outlet.

The discharge nozzles which are connected to the chamber outlets in each of the above-described embodiments are directed outwardly near the bottom of the submersible pump. Preferably, a pair of identical nozzles are provided on opposite sides directed radially from the pump so that the reactive forces from the discharge nozzles are equal and opposite, resulting in no net force being applied to the submersible pump unit. Alternately, instead of the radially directed discharge nozzles, each of the discharge nozzles can have a tangential component. The tangential component of each discharge nozzle is in the same rotational direction and opposes somewhat the motor torque of the pump drive motor. The tangentially directed nozzles provide a rotative force in the liquid being pumped by the pump mixer.

It is also contemplated to utilize discharge nozzles which provide a vertical component to the discharge flow in addition to the primary radial and/or tangential component.

BRIEF DESCRIPTION OF THE DRAWINGS

FIG. 1 is a side elevational view of a submersible mixing pump according to the principles of the present invention;

FIG. 3 is a horizontal cross section along line III—III of FIG. 2 showing the annular cooling chamber of the present invention and with the motor elements deleted;

FIG. 4 is a fragmentary cross section along arc IV—IV of FIG. 3 showing partial and full dividing walls of a second embodiment;

FIG. 5 is a bottom plan view of the pump of FIG. 1 showing the relationship of the pump volute and the discharge nozzles; and FIG. 6 is a bottom plan view of the present pump showing an alternate arrangement of the discharge nozzles.

DESCRIPTION OF THE PREFERRED EMBODIMENTS

Figure 2:
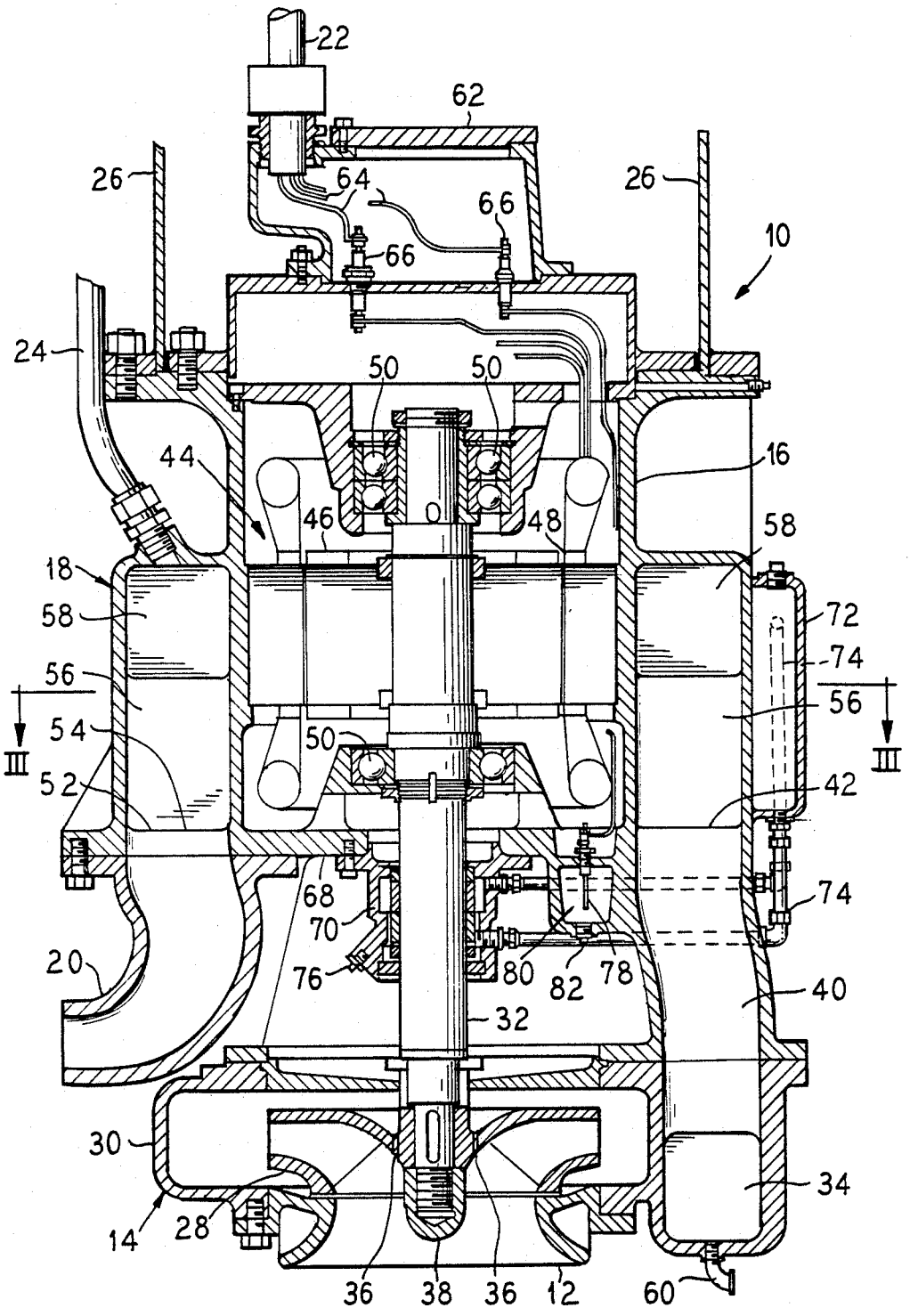
FIG. 2 is a vertical cross section along line II—II of the submersible pump shown in FIG. 5, each half of FIG. 2 being a cross section taken in quadrature with respect to the other half.

In FIG. 1 is shown a submersible mixing pump generally at 10 with a bottom inlet 12 that feeds a centrifugal pump 14 which is driven by a motor within a motor housing 16. The motor housing 16 is surrounded by a chamber 18 from which extends a pair of nozzles 20. Power is supplied to the motor within the motor housing 16 through a power feed conduit 22. A pair of flushing tubes 24 connect to the chamber 18. The submersible pump 10 is supported by a pair of cable connections 26.

Referring to FIG. 2, the bottom inlet 12 feeds into the twin volute centrifugal pump 14 which has an impeller 28 rotationally mounted within a twin volute pump housing 30. The impeller 28 is mounted on a shaft 32, which is a cantilevered drive shaft. When the impeller 28 is rotationally driven through the shaft 32, liquid is drawn into the bottom inlet 12 and is forcefully ejected at a pair of pump outlets 34, one of which is shown. The impeller 28 includes drain holes 36 through which liquid, which has accumulated above the impeller 28, can drain when the pump 10 is not in operation. A cap 38 is provided over the end of the shaft 32 to hold the impeller 28 thereto. The cap 38 may be in the form of an agitator (not shown) for additional mixing of settled solids and for boring into any sediment accumulated on the bottom of the reservoir in which the present submersible mixing pump 10 is used.

From the pump outlet 34 there extends upwardly a passageway 40 through which liquid ejected by the pump 14 travels. The passageway 40 connects at a chamber inlet 42 to the annular chamber 18 which encircles the motor housing 16.

Within the motor housing 16 is an electric motor 44 having a rotor 46 rotationally mounted on the shaft 32 within a stator armature 48. Rotational mounting of the shaft 32 is provided by bearings 50 at either end of the motor 44.

The motor 44, and more specifically, the stator 48, is at the same height as the annular chamber 18 and is in thermal contact therewith. The passageway 40 connects into the chamber 18 at the chamber inlet 42 so that liquid from the pump 14 is forced up the passageway 40 and into the chamber 18 to cool the motor 44. The chamber 18 also has chamber outlet openings 52 which are connected to the discharge nozzles 20. Both the chamber inlets 42 and chamber outlets 52 are formed in a bottom wall 54 of the annular chamber 18. Within the chamber 18 are partial dividing walls 56 extending upward from the bottom 54 of the chamber 18. An opening 58 is defined above the dividing wall 56.

The flush conduit 24 connects to the top portion of the chamber 18 and is used to wash sediment and other material from the interior of the chamber 18. An openable drain 60 is provided at the pump output 34, also for cleaning purposes.

Since the motor housing 16 must be liquid tight, a variety of measures are included to insure that no liquid seeps into the motor 44. The cable conduit 22 connects to a cable connection housing 62 where various power and control cables 64 are connected to cable feedthroughs 66 which provide watertight electrical communication into the motor housing 16. At a lower end 68 of the motor housing, a mechanical seal 70 is provided around the shaft 32. Positive liquid pressure is maintained in the mechanical seal 70 by barrier fluid which provide a substantially frictionless blockage to prevent the ingress of liquid into the motor housing 16, particularly as the shaft 32 is rotating. Barrier fluid is supplied to the mechanical seal 70 from a barrier fluid reservoir 72 which is mounted on the outside of the chamber 18. The barrier fluid flows from the barrier fluid reservoir 72 through conduits 74 which are connected to the mechanical seal 70. A drain 76 is provided for draining the mechanical seal.

As added insurance against moisture seepage, a moisture sensor 78 is provided in a well 80, where liquid accumulates should any seep into the motor housing 16. A drain plug 82 is provided in the well 80 to drain the accumulated liquid therefrom.

In FIG. 3, the annular chamber 18 includes four of the divider walls 56 extending radially outward from the motor housing 16 to an outside wall 86 of the chamber 18. The divider walls 56 divide the annular chamber 18 into four equal segments, each segment including either a chamber inlet 42 or a chamber outlet 52. Thus, each chamber inlet 42 is separated from the adjoining chamber outlets 52 by one of the dividing walls 56. Liquid coming in through the chamber inlets 42 is forced to flow upward at least as high as the top of the divider walls 56 before it can flow to the adjoining segments and down through the chamber outlets 52 and out through the discharge nozzles 20. The height of the dividing walls 56, thus, controls the level of the liquid within the annular chamber 18 to insure that it is at least as high as the motor stator 48 and thereby cools the motor 44 during operation thereof. The chamber 18 has an annular shape to provide thermal transfer surface about the entire periphery of the motor housing. The divider walls 56 provide an additional heat transfer surface, as well. It is foreseen to include additional heat transfer means on the motor housing, such as fins or ridges on the surface thereof, depending on the liquid being pumped. In FIG. 3, the motor 44 is not shown for the sake of simplicity.

In an alternate embodiment, two of the dividing walls 56 at opposite sides of the annular chamber 18 completely block the annular chamber 18 so that no opening 58 is formed. Therefore, liquid from each one of the chamber inlets 42 can flow out only one of the chamber outlets 52. In FIG. 4, this second embodiment is shown in an arcuate cross section through the annular chamber 18. The partial dividing wall 56 is between the chamber inlet 42 and the chamber outlet 52. Blocking walls 56A are shown completely blocking the annular chamber 18 so that liquid flow from one of the twin pump volutes is through a single one of the openings 58 and to a single one of the discharge nozzles 20.

Referring now to FIG. 5, the twin volute pump housing 30 is shown from below with the bottom inlet 12 and the two pump outputs 34 through which the pumped liquid is forced. After traversing the annular chamber 18 (FIG. 1), the pumped liquid is ejected from the nozzles 20, which are oppositely directed so that no net force on the pump 10 results during its operation.

In an alternate embodiment shown in FIG. 6, angularly directed nozzles 90 may be provided in place of the radial nozzles shown in FIG. 5. The angular nozzles 90 are tangentially directed in the same rotational direction and, thereby, impart a rotative force to the liquid being ejected from the mixer pump 10 for improved agitation. It is contemplated that the nozzles 20 and/or 90 may have a vertical component of flow in addition to the primary radial tangential component, depending upon the application. The torque generated by the angled nozzles 90 is generally not enough to move the heavy unit 10 on the bottom of the reservoir in which it rests, although in place of the cable restraints 26, various other mounting devices may be provided.

Thus, the present submersible mixing pump 10 provides a twin volute bottom inlet pump 14 feeding an annular chamber 18 which extends around the motor 44 for cooling and from which a pair of nozzles 20 or 90 eject the pumped liquid to agitate a liquid bath in which the pump 10 sits. Dividing walls 56 are provided within the annular chamber 18 to insure that the liquid level is maintained at least as high as the motor stator 48 and, thus, cooling is provided during motor operation even when the unit 10 is not submersed, so long as some liquid is being drawn into the pump 14. The nozzles 20 or 90 eject the pumped liquid directly into the liquid bath in which the unit 10 sits to insure a high state of agitation and prevent settling of solids.

Although other modifications and changes may be suggested by those skilled in the art, it is the intention of the inventor to embody within the patent warranted hereon all changes and modifications as reasonably and properly come within the scope of his contribution to the art.

I claim as my invention

1. A submersible pump for operation as a mixer in a tank or liquid reservoir containing liquids or mixtures of liquids and solids, comprising:

a motor encased within a motor housing, said motor having an output shaft;

a pump mechanism mounted below said motor and connected for operation to said output shaft of said motor, said pump mechanism having an inlet below said motor housing for drawing in liquids and at least one outlet for expelling liquids drawn in through said inlet;

an annular chamber encircling said motor housing, said chamber being in thermal communication with said motor within said motor housing and having at least one chamber inlet opening and at least one chamber outlet each in a lower wall of said annular chamber;

a first passageway connected to provide communication between said at least one outlet of said pump mechanism and said at least one chamber inlet opening of said chamber; and first and second discharge nozzles connected to said at least one chamber outlet to expel liquid from said annular chamber into the liquid reservoir in substantially opposite directions.

2. A submersible pump as claimed in claim 1, further comprising:

a first partition wall in said annular chamber between said at least one chamber inlet opening and said at least one chamber outlet, said first partition wall extending only partially upward from said lower wall of said chamber to define an opening above said partition wall for communication between said at least one chamber inlet opening and said at least one chamber outlet.

3. A submersible pump as claimed in claim 1, wherein said pump mechanism is a volute centrifugal pump.

4. A submersible pump as claimed in claim 3, wherein said pump mechanism is a twin volute centrifugal pump having first and second pump outlets, said chamber includes first and second chamber inlets, said first passageway is connected between said first pump outlet and said first chamber inlet opening of said chamber, and, further comprising:

a second passageway connected between said second pump outlet and said second chamber inlet.

5. A submersible pump for operation as a mixer in a tank or liquid reservoir containing liquids or mixtures of liquids and solids, comprising:

a motor encased within a motor housing, said motor having an output shaft;

a twin volute centrifugal pump mechanism mounted below said motor and connected for operation to said output shaft of said motor, said pump mechanism having an inlet below said motor housing for drawing in liquids and first and second pump outlets for expelling liquids drawn in through said inlet;

an annular chamber encircling said motor housing, said chamber being in thermal communication with said motor housing and having first and second chamber inlet openings and first and second chamber outlets each in a lower wall of said annular chamber;

a first passageway connected to provide communication between said first outlet of said pump mechanism and said first chamber inlet opening of said chamber;

a first discharge nozzle connected to said first chamber outlet to expel liquid from said annular chamber to the liquid reservoir;

a second passageway connected between said second pump outlet and said second chamber inlet;

a second discharge nozzle connected at said second chamber outlet in said chamber; and a second partition wall between said second chamber inlet opening and said second chamber outlet extending partially across said chamber to define an opening through which liquid flows from said second chamber inlet opening to said chamber outlet.

6. A submersible pump for operation as a mixer in a tank or liquid reservoir containing liquids or mixtures of liquids and solids, comprising:

a motor encased within a motor housing, said motor having an output shaft;

a pump mechanism mounted below said motor and connected for operation to said output shaft of said motor, said pump mechanism having an inlet below said motor housing for drawing in liquids and at least one outlet for expelling liquids drawn in through said inlet;

an annular chamber encircling said motor housing, said chamber being in thermal communication with said motor within said motor housing and having at least one chamber inlet opening and at least one chamber outlet each in a lower wall of said annular chamber;

a first passageway connected to provide communication between said at least one outlet of said pump mechanism and said at least one chamber inlet opening of said chamber;

said at least one chamber outlet being first and second chamber outlets in said chamber; and first and second discharge nozzles connected to respective ones of said first and second chamber outlets, said first and second discharge nozzles being directed to eject liquid to the liquid reservoir in substantially opposite directions.

7. A submersible pump for operation as a mixer in a tank or liquid reservoir containing liquids or mixtures of liquids and solids, comprising:

a motor encased within a motor housing, said motor having an output shaft;

a pump mechanism connected for operation by said output shaft of said motor, said pump mechanism having an inlet below said motor housing for drawing in liquids and at least one outlet for expelling liquids drawn in through said inlet;

a chamber adjacent said motor housing, said chamber being in thermal communication with said motor within said motor housing and having a chamber inlet opening and a chamber outlet;

a first passageway connected to provide communication between said at least one outlet of said pump mechanism and said chamber inlet opening of said chamber;

a discharge nozzle connected to said chamber outlet to expel liquid from said chamber to the liquid reservoir;

first and second chamber outlets in said chamber; and first and second discharge nozzles connected to respective ones of said first and second chamber outlets, said first and second discharge nozzles being directed to eject liquid to the liquid reservoir in substantially opposite directions, wherein said first and second discharge nozzles eject liquid radially from said submersible pump to the liquid reservoir in mutually opposite directions.

8. A submersible pump for operation as a mixer in a tank or liquid reservoir containing liquids or mixtures of liquids and solids, comprising:

a motor encased within a motor housing, said motor having an output shaft;

a pump mechanism connected for operation by said output shaft of said motor, said pump mechanism having an inlet below said motor housing for drawing in liquids and at least one outlet for expelling liquids drawn in through said inlet;

a chamber adjacent said motor housing, said chamber being in thermal communication with said motor within said motor housing and having a chamber inlet opening and a first chamber outlet;

a first passageway connected to provide communication between said at least one outlet of said pump mechanism and said chamber inlet opening of said chamber;

a second chamber outlet in said chamber; and first and second discharge nozzles connected to respective ones of said first and second chamber outlets, said first and second discharge nozzles being directed to eject liquid to the liquid reservoir in substantially opposite directions, wherein said first and second discharge nozzles eject liquid in a direction having at least a tangential component with respect to said submersible pump, said tangential component from each of said first and second discharge nozzles being in the same rotational direction.

9. A submersible pump for use in a slurry within a liquid reservoir, comprising:

a motor encased within a motor housing, said motor having an output shaft and a stator;

a pump mechanism connected for operation by said output shaft of said motor, said pump mechanism having an inlet below said motor housing for drawing in liquids and at least one outlet for expelling liquids drawn in through said inlet;

an annular chamber encircling said motor housing and in thermal communication with said motor within said motor housing, said annular chamber having at least one chamber inlet opening in a lower wall of said annular chamber and at least one chamber outlet in a lower wall of said annular chamber;

a first passageway connected between said at least one pump outlet and said at least one chamber inlet opening;

first and second partitions extending across said annular chamber on each side of said at least one chamber inlet opening and between said at least one chamber inlet opening and said at least one chamber outlet, at least one of said first and second partitions being a partial partition extending upwardly from said lower wall of said annular chamber and defining an opening adjacent a top wall of said annular chamber so that liquid being pumped by said pump mechanism attains a predetermined level within said annular chamber before reaching said at least one chamber outlet; and first and second discharge nozzles in communication with said at least one chamber outlet to direct liquid from said annular chamber into the liquid reservoir in substantially opposite directions.

10. A submersible pump for use in a slurry within a liquid reservoir, comprising:

a motor encased within a motor housing, said motor having an output shaft and a stator;

a pump mechanism connected for operation by said output shaft of said motor, said pump mechanism having an inlet below said motor housing for drawing in liquids and at least one outlet for expelling liquids drawn in through said inlet;

an annular chamber encircling said motor housing and in thermal communication with said motor within said motor housing, said annular chamber having at least one chamber inlet opening and at least one chamber outlet;

a first passageway connected between said at least one pump outlet and said at least one chamber inlet opening;

first and second partitions extending across said annular chamber on each side of said at least one chamber inlet opening and between said at least one chamber inlet opening and said at least one chamber outlet, at least one of said first and second partitions being a partial partition defining an opening so that liquid being pumped by said pump mechanism attains a predetermined level within said annular chamber before reaching said at least one chamber outlet;

first and second pump outlets for expelling liquids pumped by said pump;

first and second passageways connected to respective ones of said first and second pump outlets;

first and second chamber inlet openings in communication with said first and second passageways;

first and second chamber outlets in said chamber on said each side of said first chamber inlet opening;

said first and second partitions being on each side of said first chamber inlet opening between said first chamber inlet opening and a respective one of said first and second chamber outlets;

third and fourth partitions extending across said annular chamber on each side of said second chamber inlet opening and between said second chamber inlet opening and a respective one of said first and second chamber outlets, at least one of said third and fourth partitions being a partial partition.

11. A submersible pump as claimed in claim 10, wherein said first, second, third, and fourth partitions are partial partitions defining an opening at the top of each through which pumped liquid flows.

12. A submersible slurry mixing pump for recirculating a liquid within a container, comprising:

an electric motor including a stator and a rotor rotationally mounted on a motor shaft within said stator, said motor shaft defining a generally vertical axis;

a liquid-tight motor housing encasing said electric motor;

means for connecting electric power to said electric motor in liquid-tight fashion;

a twin volute centrifugal pump having an input connected to said motor shaft, said twin volute pump having first and second pump outlets and a centrally disposed bottom inlet for drawing in liquid to said pump;

first and second liquid passageways connected to respective ones of said first and second pump outlets, said first and second passageways each extending substantially parallel to said vertical axis;

an annular chamber extending around said motor housing at said stator, said annular chamber being in thermal contact with said electric motor and including first and second chamber inlets in a bottom portion of said annular chamber in fluid communication with respective ones of said first and second passageways, first and second chamber outlets in the bottom portion of said annular chamber spaced from said first and second chamber inlets, each of said chamber outlets between said first and second chamber inlets and at respective opposite sides of said annular chamber;

first and second ejection nozzles connected to respective ones of said first and second chamber outlets to eject liquid that has been pumped through said mixing pump back into the container; and four dividing walls extending radially within said annular chamber and each separating said annular chamber between one of said chamber outlets and an adjacent one of said chamber inlets, at least two of said dividing walls providing a passage at a top of said annular chamber for fluid communication between respective ones of said chamber inputs and chamber outputs;

whereby liquid pumped through said pump mechanism passes through said annular chamber to cool said motor prior to being ejected from said nozzles.

* * * * *